US005556285A

United States Patent [19]

Ono

[11] Patent Number: 5,556,285

[45] Date of Patent: Sep. 17, 1996

[54] ELECTRICAL CONNECTOR

[75] Inventor: Hisahiro Ono, Tsu, Japan

[73] Assignee: Matsushita Electric Works, Ltd., Osaka, Japan

[21] Appl. No.: 341,122

[22] Filed: Nov. 18, 1994

[30] Foreign Application Priority Data

Dec. 15, 1993 [JP] Japan ..... 5-314889
Apr. 25, 1994 [JP] Japan ..... 6-086815

[51] Int. Cl.[6] ..... H01R 9/09; H01R 13/10

[52] U.S. Cl. ..... 439/74; 439/860

[58] Field of Search ..... 439/74, 75, 83, 439/856, 857, 860

[56] References Cited

U.S. PATENT DOCUMENTS 5,188,535 2/1993 Bertho et al. ..... 439/82

FOREIGN PATENT DOCUMENTS 3-8885 1/1991 Japan .
4-14382 2/1992 Japan .
4-129484 11/1992 Japan .
207373 11/1923 United Kingdom .
1201372 8/1970 United Kingdom .

*Primary Examiner*—Neil Abrams
*Attorney, Agent, or Firm*—Watson Cole Stevens Davis P.L.L.C.

[57] ABSTRACT

An electrical connector is composed of a socket and a plug. The socket is made of flat configuration which is capable of reducing the height or thickness along a direction of inserting the plug into the socket. The socket has a socket base (10) mounting contacts (20) with a slot (22). The plug having a plug base (30) which carries posts (40) extending perpendicular to the plug base. The post is adapted to have its end engaged into the slot (22) with the plug base (30) held in parallel with the socket base (10) for electrical interconnection between the post (40) and the contact (20). The contact (20) is made flat to have the slot extending generally in parallel with the planar socket base, thereby reducing the dimension of the socket along the inserting direction of the post.

6 Claims, 7 Drawing Sheets

ELECTRICAL CONNECTOR

BACKGROUND OF THE INVENTION

1. Field of the Invention

The present invention is directed to an electrical connector, and more particularly to a plug-in type socket utilized in the connector.

2. Description of the Prior Art

A plug-in type socket generally comprises a socket base and contacts carried thereon for connection with associated conductors, i.e., pins or posts of a plug. Such socket and plug are known in prior electrical connector as disclosed. for example, in Japanese Utility Model Early Publication (KOKAI) Nos. 3-8885, 4-14382, and 4-129484. As illustrated generally in FIG. 17 of the attached drawings, the contacts 20A in the conventional socket 10A are generally designed to have slots 22A which are elongated in the direction of inserting the post 40A of the plug 30A with a correspondingly increased height dimension for the contacts and therefore the socket. With this result, the connector occupies a great height H between the socket and plug. Where only a limited height is permitted at electrical connection, for example, between connection of closely stacked printed boards, the above prior connector fails to satisfy such requirement. Therefore, a socket of reduced height is desired to enable the electrical connection within a space of limited thickness or height.

SUMMARY OF THE INVENTION

To satisfy the above requirement, the present invention has been achieved to provide an electrical connector having a socket of flat configuration which is capable of reducing the height or thickness along a direction of inserting a plug into the socket. The electrical connector in accordance with the present invention comprises a socket having a socket base (10) mounting contacts (20) with a slot (22), and a plug having a plug base (30) carrying posts (40) extending perpendicular to the plug base. The post is adapted to have its end engaged into the slot (22) with the plug base (30) held in parallel with the socket base (10) for electrical interconnection between the post (40) and the contact (20). The contact (20) is made flat to have the slot extending generally in parallel with the planar socket base, thereby reducing the dimension of the socket along the inserting direction of the post.

In a preferred embodiment, the contact (20) is configured to have a pair of elongated legs (21) which defines therebetween the slot (22). The elongated legs (21) are formed at their free ends respectively with bulges (23) projecting to give a constriction at one end of the slot (22) between the legs so that the slot has a varying width along the length of the slot. The post (40) is configured to have a trunk (41) and a pilot (42) at an end of the trunk. The trunk and pilot are dimensioned to have a length extending along the length of the slot, a thickness along the width of the slot, and a height in the projecting direction of the post. The slot (22) has a wider section of which width W1 is greater than the thickness T1 of the trunk (41) and a narrow section at the constriction of which width W2 is less than the thickness T1 of the trunk (41). The pilot (42) is tapered to have opposed inclined side faces (43) and have a reduced tip thickness T2 which is less than the width W2 at the narrower section. The pilot (42) is cut off at one longitudinal end portion thereof to define thereat a beveled edge (44) which is angled with a remaining square edge (45) at the tip of the pilot. The pilot (42) is in use adapted to be inserted into the slot (22) with the square edge (45) leading into the wider section and with the beveled edge (44) leading into the narrow section so that the post (40) is engaged at a portion adjacent the opposed inclined side faces (43) with the bulges (23). Thus, the pilot can be easily guided into an exact contacting position where the post is engaged at the portion corresponding to the beveled edge with the bulges at the narrow section of the contact after the square edge is smoothly led into the slot of wide section. This facilities the insertion of the post into the slot of the contact and lessens a force required to insert the pilot into the slot, which prevents buckling of the post and therefore assures reliable electrical connection over repeated connections and disconnections. The beveled edge is preferred to be inclined at an angle $\alpha$ of 30° to 80° with respect to the square edge (45) along the length of the pilot (42). The inclined side faces (43) are preferred to be inclined at an angle $\beta$ of 15° to 45° with respect to a vertical line extending along the height of the post (40).

Further, each of the bulges (23) has a vertex which is continuous with a remaining inner edge (25) of said leg (21) through a slope (24) which is inclined at an angle $\gamma$ of 5° to 45° with respect to the inner edge (25) along the length of the slot. It is this slope that is cooperative with the inclined side face to smoothly guide the inclined side face into engagement with the bulge of the contact to further facilitate the insertion of the post into engagement with the contact.

The electrical connector is best utilized for connection between closely stacked printed board without requiring additional height or thickness for connection between the printed boards. In this application, the socket and plug are surface-mounted respectively on first and second printed boards. To this end, the socket includes socket terminals which extend respectively from the contacts outwardly of the socket base and are adapted to be bonded to conductors on the first printed board. Likewise, the plug includes plug terminals which extend respectively from the posts outwardly of said plug base and are adapted to be bonded to conductors on the second printed board. Thus surface-mounted socket and plug allow the interconnection between the closely stacked printed boards.

These and still other objects and advantageous features of the present invention will become more apparent from the following detailed description of the preferred embodiment when taken in conjunction with the attached drawings.

DETAILED DESCRIPTION OF THE PREFERRED EMBODIMENT

Figure 1:
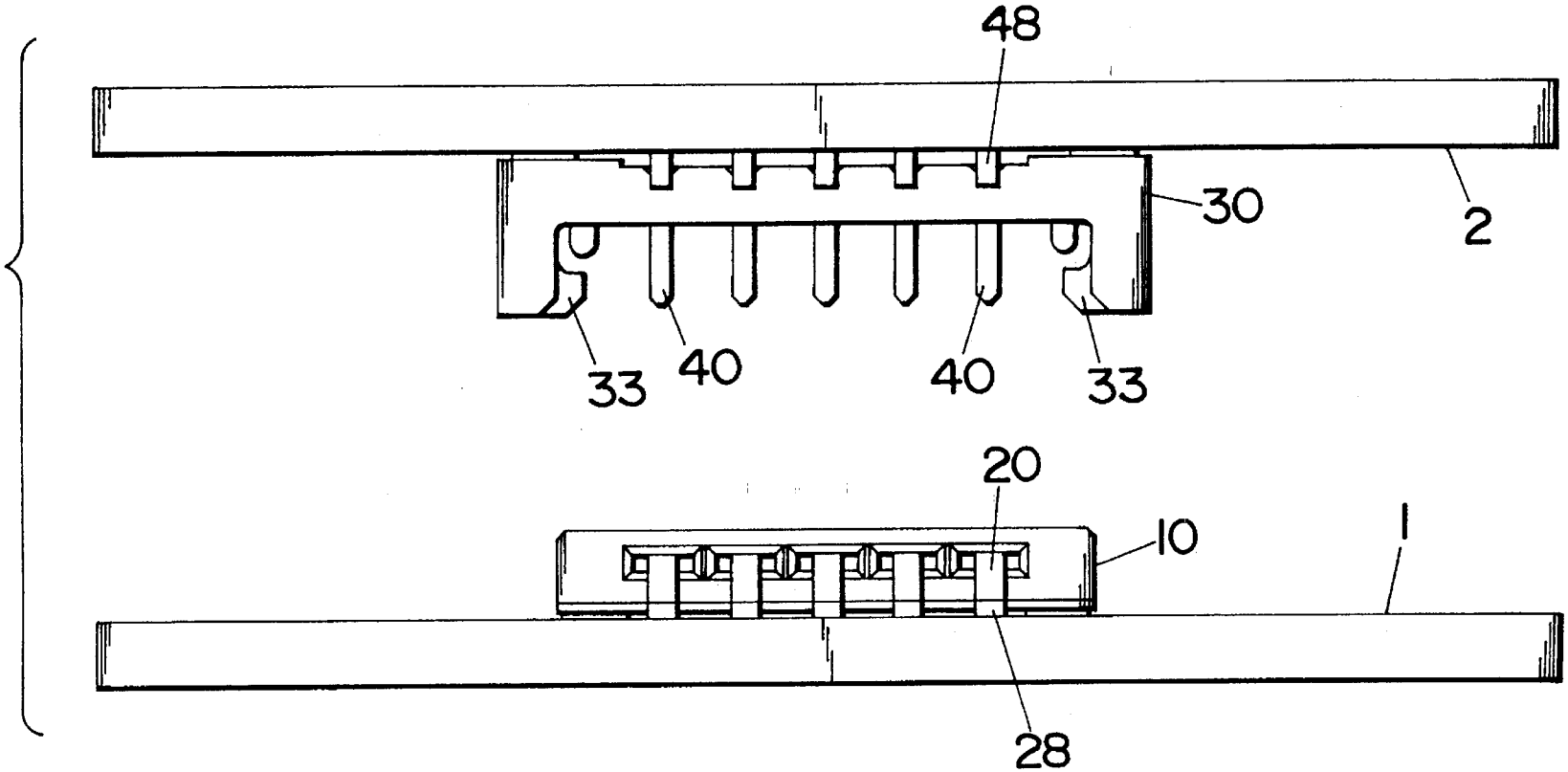
FIG. 1 is an exploded view of an electrical connector in accordance with a preferred embodiment of the present invention which is composed of a socket and a plug shown as mounted on printed boards for interconnection therebetween.
Figure 2:
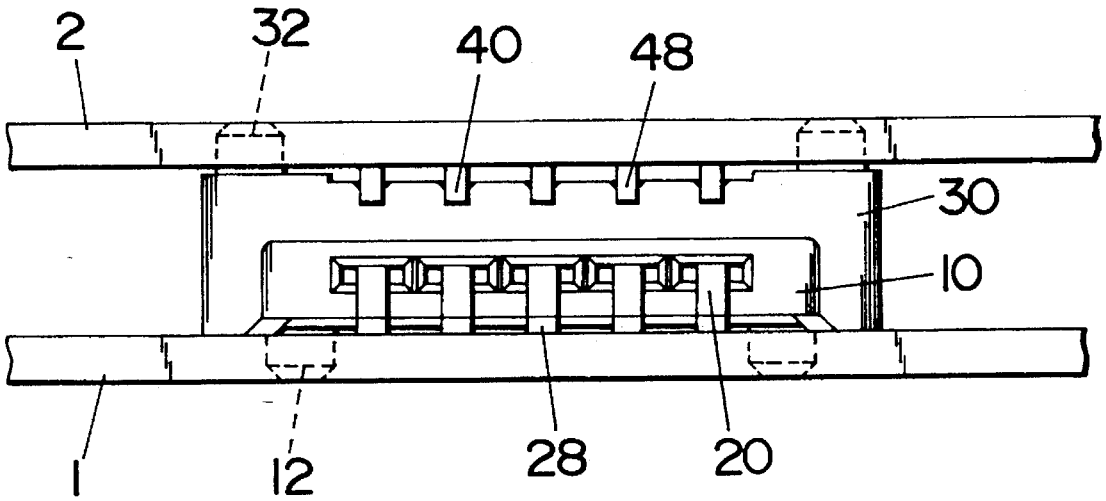
FIG. 2 illustrates the socket and the plug in the connected position.
Figure 3:
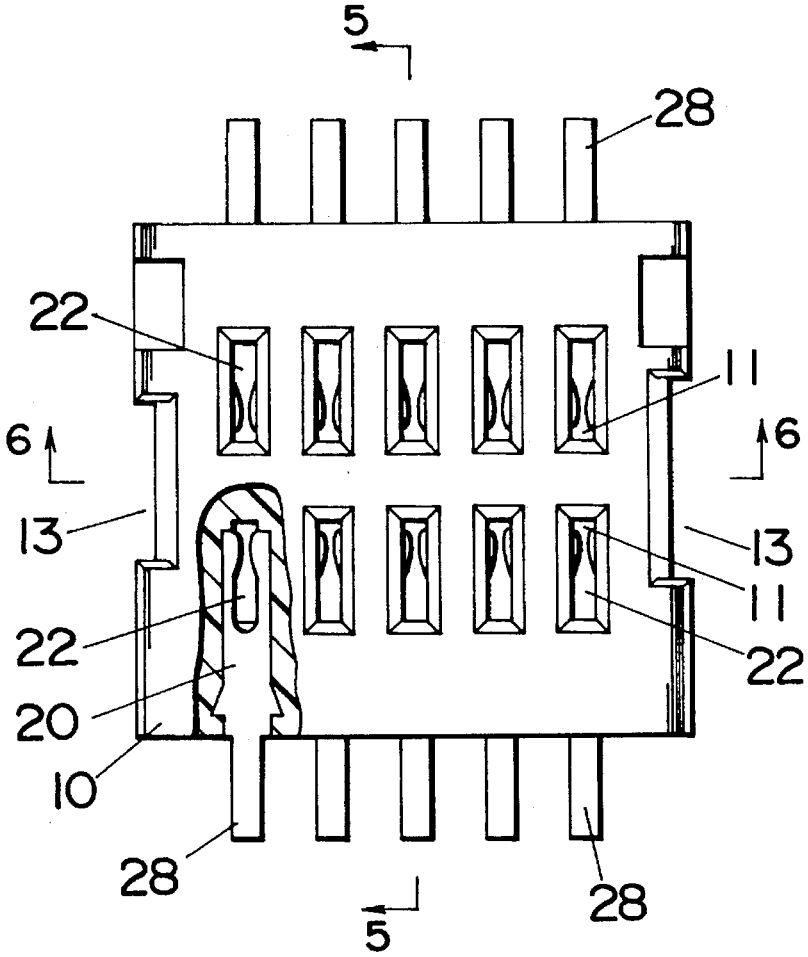
FIG. 3 is a top view of the socket.
Figure 4:
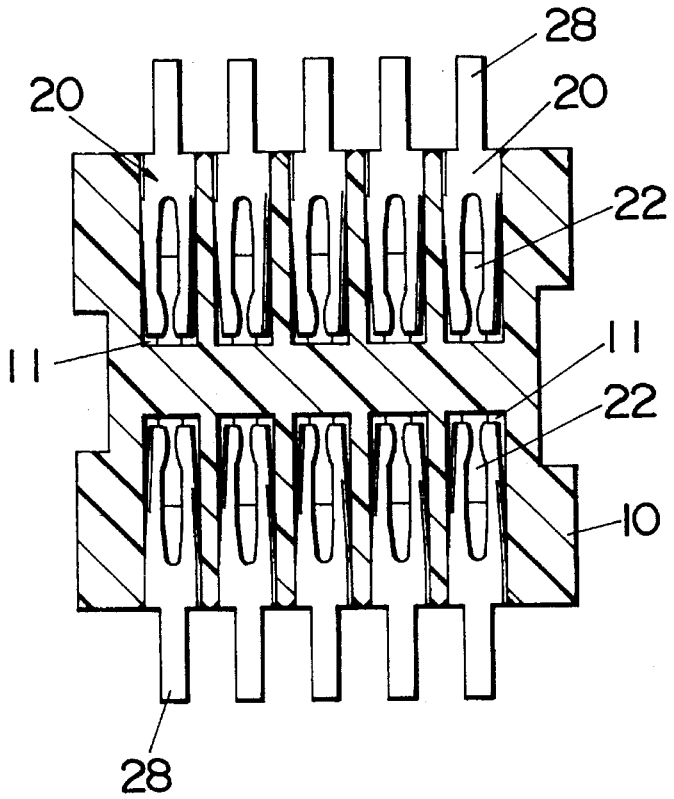
FIG. 4 is a horizontal section of the socket.
Figure 5:
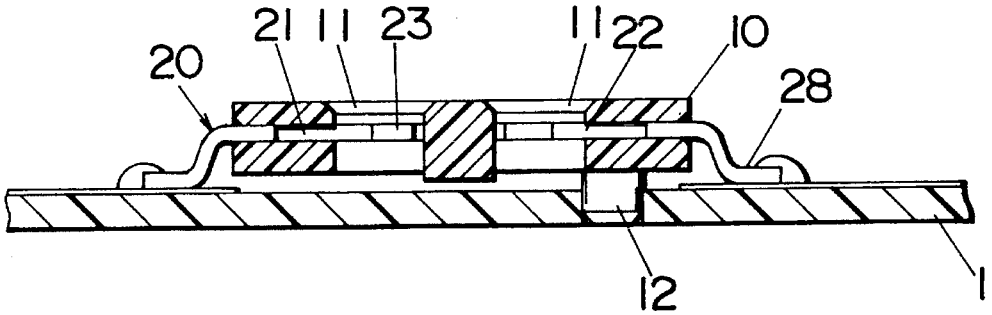
FIG. 5 is a vertical section taken along line 5—5 of FIG. 3.
Figure 6:
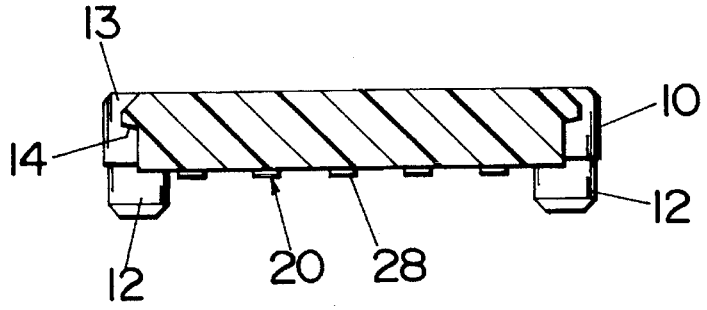
FIG. 6 is a vertical section taken along line 6—6 of FIG. 3.
Figure 7:
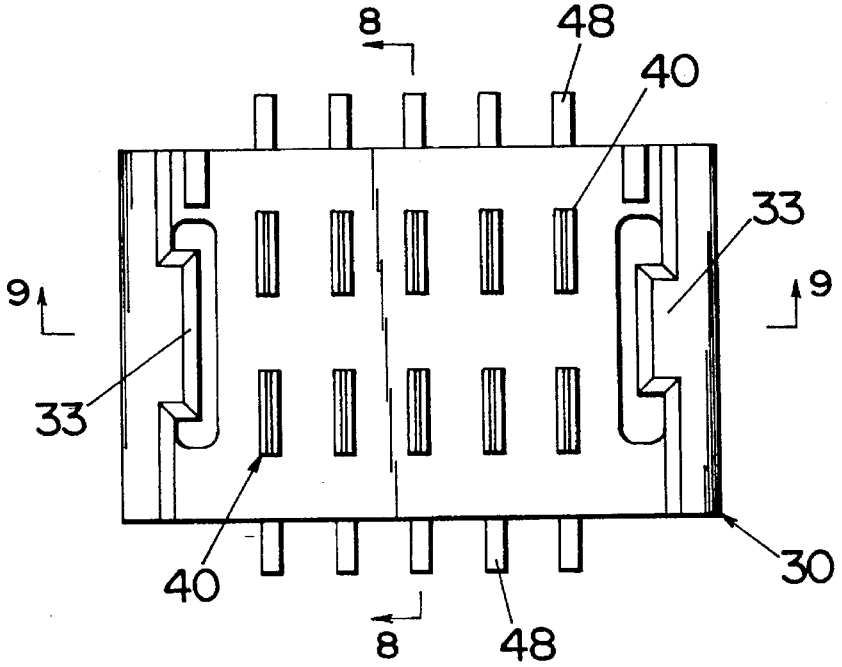
FIG. 7 is a bottom view of the plug.
Figure 8:
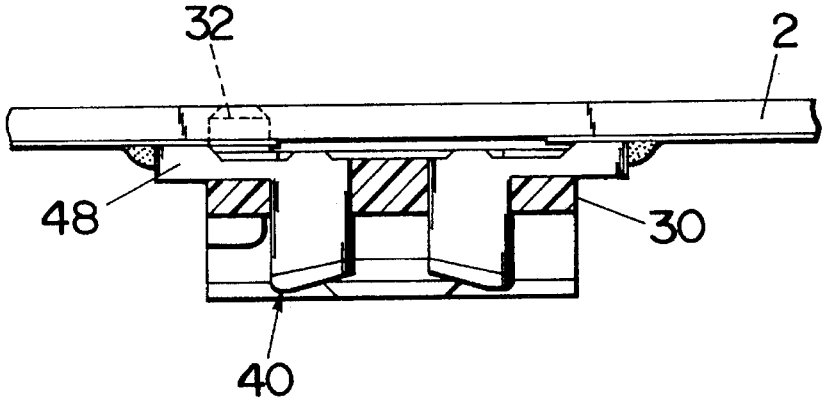
FIG. 8 is a vertical section taken along line 8—8 of FIG. 7.
Figure 9:
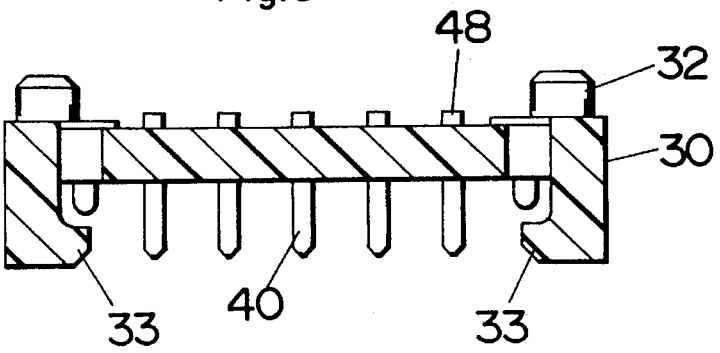
FIG. 9 is a vertical section taken along line 9—9 of FIG. 7.

Referring now to FIGS. 1 and 2, there is shown an electrical connector in accordance with a preferred embodiment of the present invention which is configured for electrical interconnection between a pair of stacked printed boards 1 and 2, although the present invention is not limited thereto. The connector is composed of a socket and a plug which are surface-mounted on the first printed board 1 and the second printed board 2, respectively. The socket comprises a socket base 10 of electrically insulative plastic material into which plural sets of contacts 20 are press-fitted. The plug comprises a plug base 30 of electrically insulative plastic material into which plural sets of posts 40 are press-fitted. The socket base 10 is of a flat configuration which is formed, as shown in FIGS. 3 and 5, in its flat top surface with openings 11 through which the posts 40 project for connection with the associated contacts 20. Projecting on the bottom of the socket base 10 are studs 12 which are fitted into corresponding holes in the printed board 1. Each of contacts 20 has a socket terminal 28 projecting horizontally outwardly of the socket base 10 for welding to a corresponding conductor on the first printed board 1, as best shown in FIG. 5. The plug base 30 is also of a flat configuration having a flat bottom which mates upon the top surface of the socket base 10. Like studs 32 project on top of the plug base 30 for engagement into corresponding holes in the second printed board 2. Each post 40 of the plug has a plug terminal 48 projecting horizontally outwardly of the plug base 30 for welding to a corresponding conductor on the second printed board 2, as best shown in FIG. 8. The plug base 30 is formed at its opposite ends with hooks 33 which are in registration with corresponding notches 13 in the socket base 10 for latching engagement with shoulders 14 formed adjacent the notches 13, as shown in FIG. 6.

Figure 10:
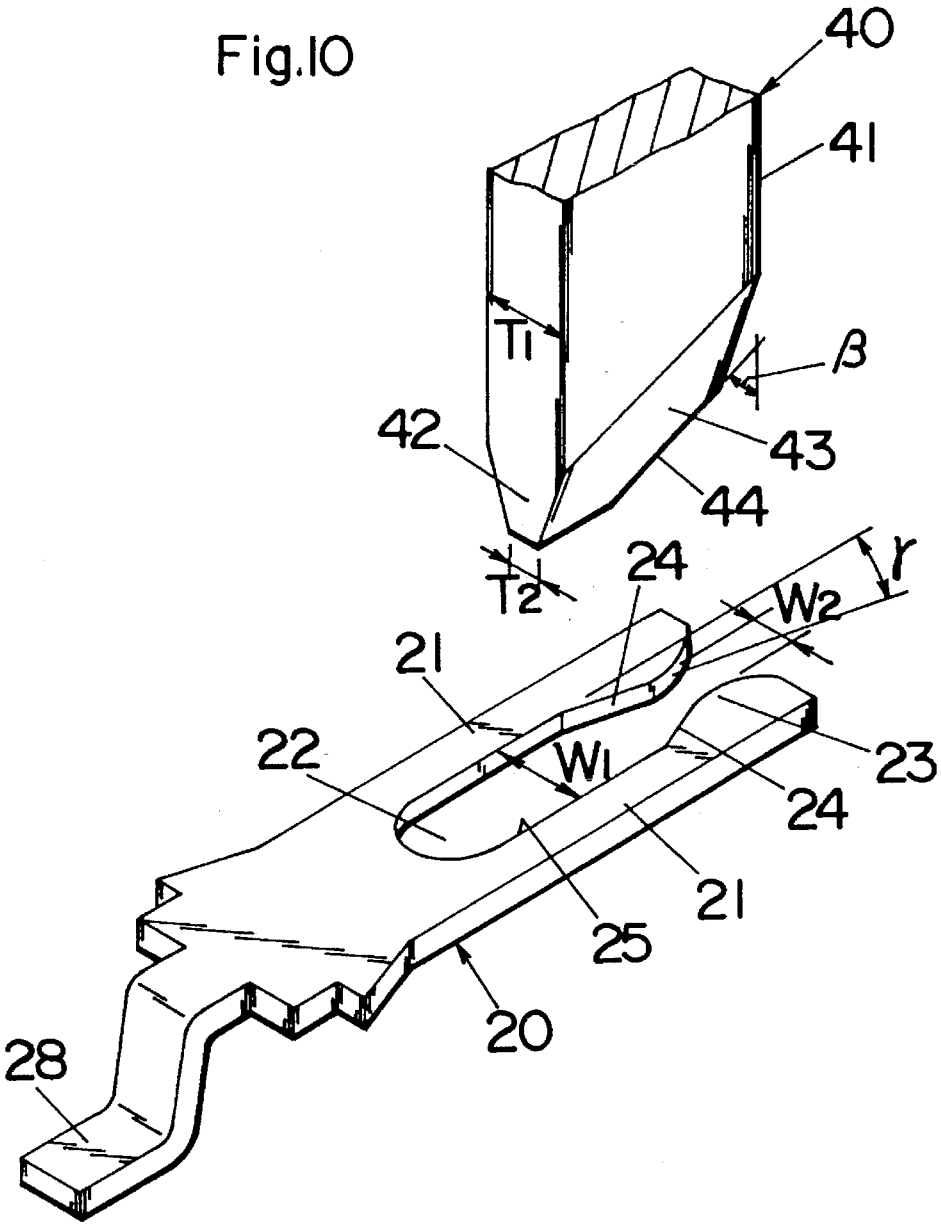
FIG. 10 is an exploded perspective view of a contact on the socket and a post of the plug.
Figure 11:
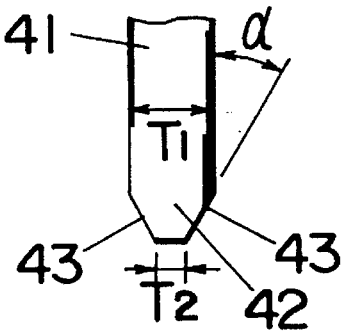
FIG. 11 is an end view of a tip portion of the post.
Figure 12:
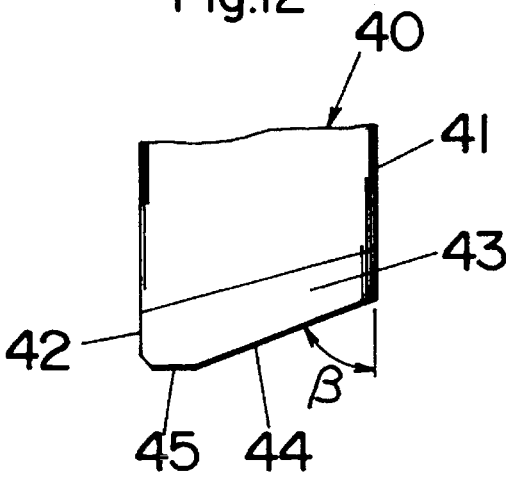
FIG. 12 is a side view of a tip portion of the post.
Figure 13:
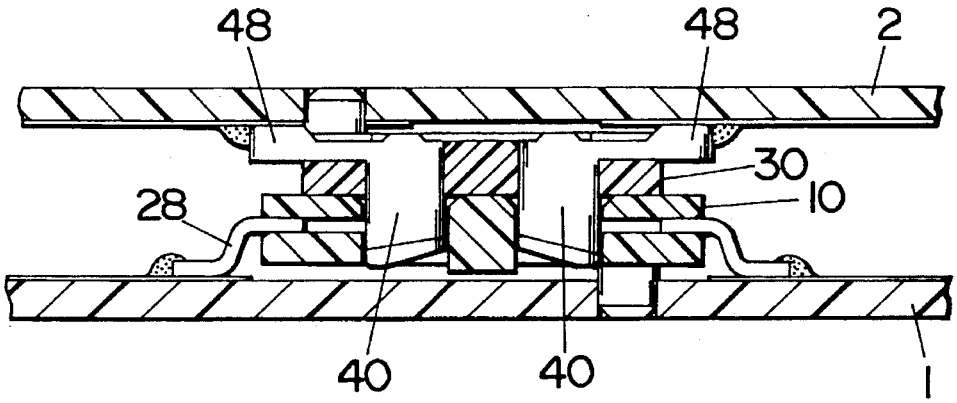
FIGS. 13 and 14 are sectional views illustrating the engagement of the post with the contact.

As shown in FIG. 10, each contact 20 is stamped from a metal stock to have a pair of elongated legs 21 which defines therebetween a slot 22 to receive the post 40 of the plug and to have the socket terminal 28. The legs 21 are permitted to resiliently flex outwardly to some extent when engaging the post 40. The legs 21 are formed at their free ends with bulges 23 projecting toward each other to give a constriction at an outer end of the slot 22. The bulge 23 has its vertex continuous with a remaining straight inner edge 215 of the leg 21 through a slope 24 which is inclined at an angle $\gamma$ of 5° to 45° with respect to the straight edge 211 along the length of the slot 22. With thus configured legs 21, the slot 22 has a wider section of a width $W_1$ adjacent the root of the legs, a narrow section of a width $W_2$ at the constriction, and an intermediate section of a width narrower towards the constriction along the slope 24.

The post 40 of the plug is in the form of a blade having a length along the length of the slot 22, a thickness along the width of the slot 22, and a height along the inserting direction of the post. The post 40 comprises a trunk 41 of a uniform thickness of $T_1$ less than width $W_1$ at the wider section of the slot 22, and a pilot 42 formed at the end of the post. The pilot 42 is tapered to have opposed inclined side faces 43 and have a reduced tip thickness $T_2$ which is greater than the width $W_2$ at the narrower section. The inclined side face has an angle $\alpha$ of 15° to 45° with respect to a vertical plane, or the side face of the trunk 41. The pilot 42 is further configured to have a beveled edge 44 at one longitudinal end thereof in correspondence to the constriction of the slot 22. The beveled edge 44 is inclined at an angle $\beta$ of 30° to 80° and merges in a square edge 45 at the extremity of the pilot 42.

Figure 14:
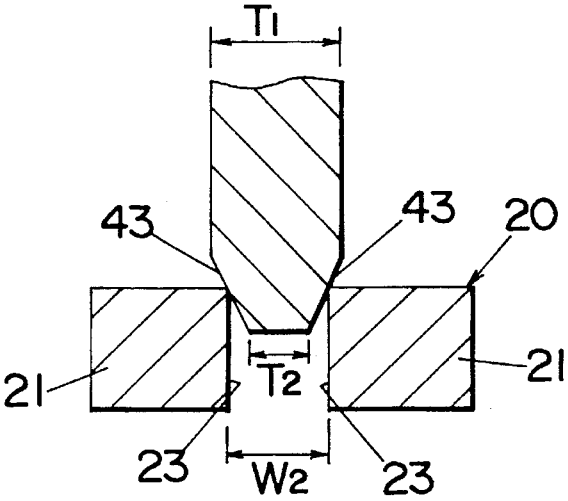
Figure 15:
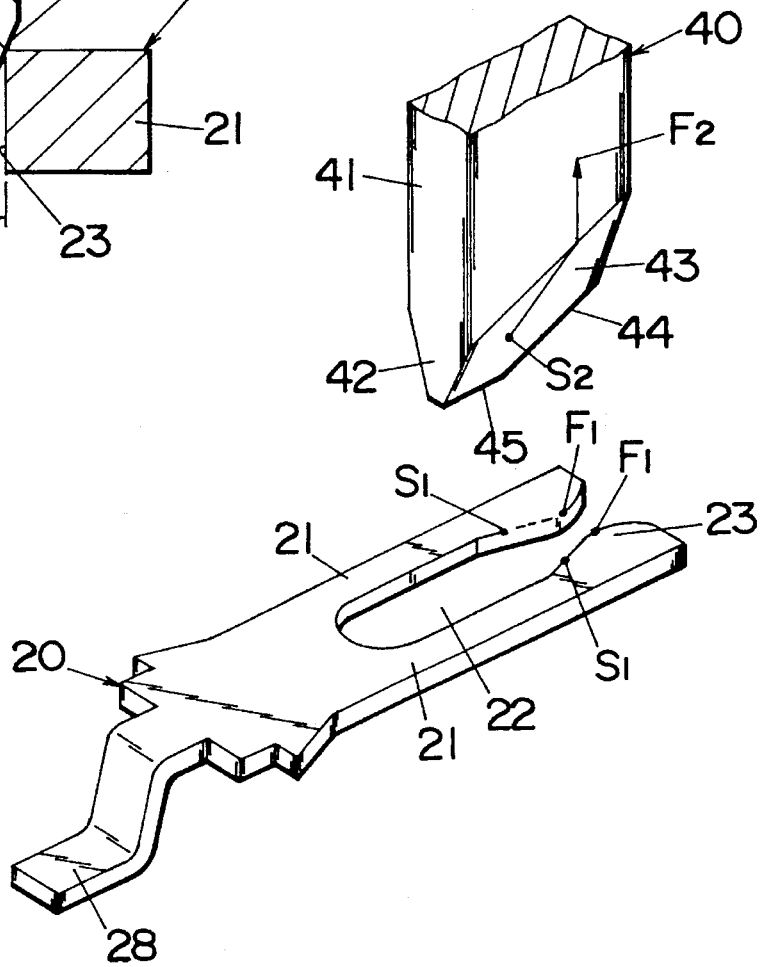
FIG. 15 illustrates a manner in which the post becomes engaged with the contact.
Figure 16:
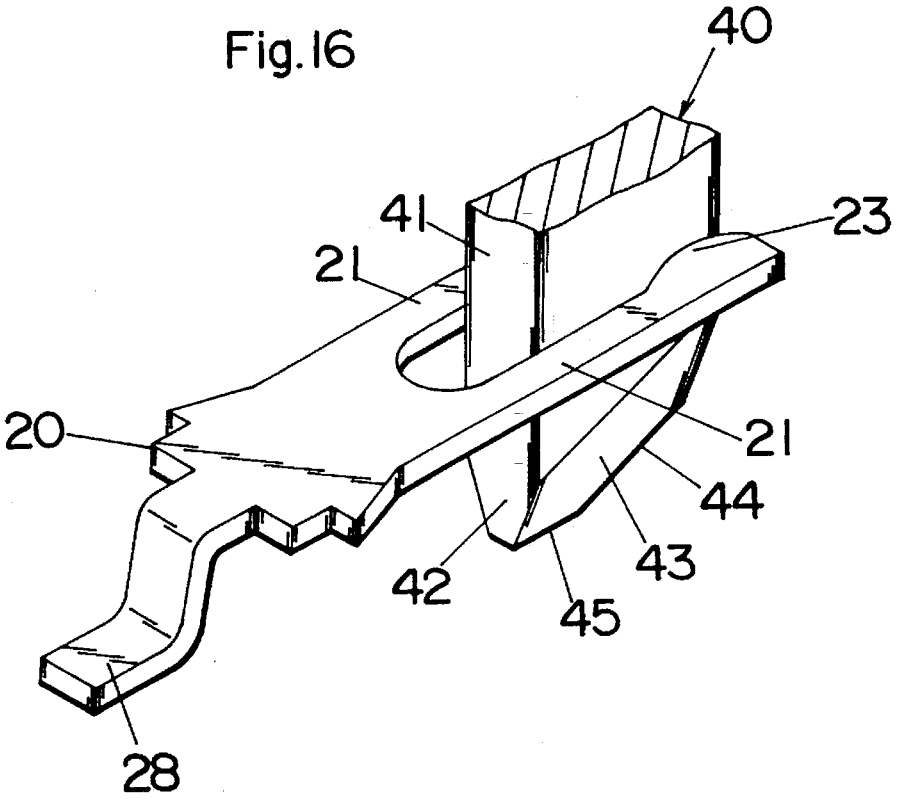
FIG. 16 is perspective view illustrating the engagement of the post with the contact.
Figure 17:
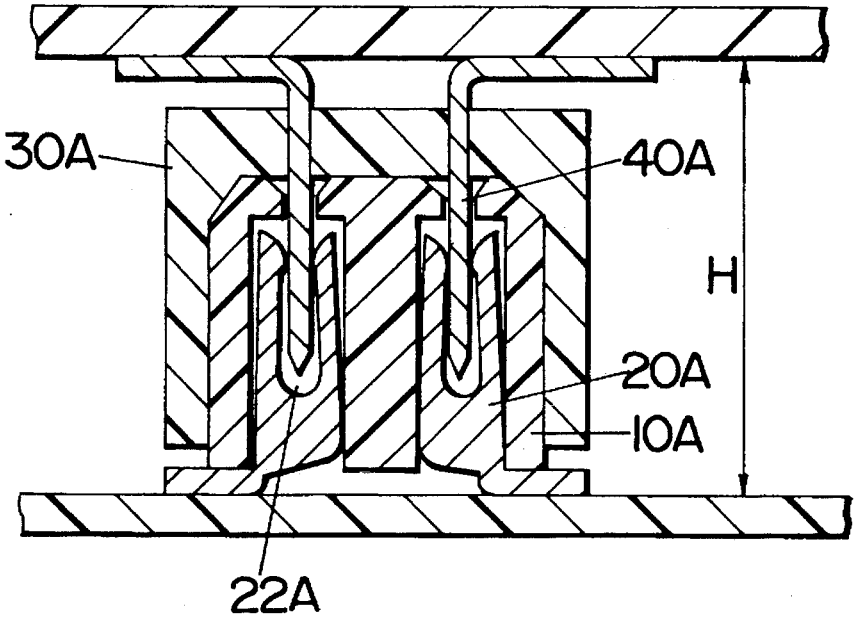
Fig.17 (PRIOR ART)
FIG. 17 is a vertical section of a conventional electrical connector.

When inserting the posts 40 into the slots 22 of the contacts 20, the square tip 45 is first led into the wider section of the slot 22 prior to the beveled edge 44 reaching the constriction at the narrower section of the slot 22. Subsequently, as the post 40 further advances, the inclined side faces 43 adjacent the beveled edge 44 are first to come into engagement with the slopes 24 of the bulges 23, at points S1 and S2 (as indicated in FIG. 15), thereby resiliently deforming the legs 21 outwardly to permit the pilot 42 to proceed into between the vertices (point F1) of the bulges 23, as shown in FIG. 14. Thereafter, the bulges 23 (point F1) are allowed to move past the inclined side faces of the pilot 42 along line $S_2$ to $F_2$ (as indicated in FIG. 15) to come into firm engagement with the trunk 41. In this manner, the posts 40 are firmly gripped with the corresponding contacts 20, as shown in FIG. 16.

What is claimed is:

1. An electrical connector comprising:

a socket having a planar socket base mounting a plurality of flat contacts extending generally in parallel with said socket base, each of said flat contacts formed with a slot;

a plug having a planar plug base carrying a plurality of posts extending perpendicular to said plug base, each of said posts being adapted to have its end engaged into said slot with said plug base held in parallel with said socket base for electrical interconnection between said posts and said contacts, said flat contacts having a pair of elongated legs which defines therebetween said slot, said elongated legs formed at their free ends respectively with bulges projecting to give a constriction at one end of said slot between said legs so that said slot has a varying width along the length of said slot, said post comprising a trunk and a pilot at an end of said trunk, said trunk and pilot being dimensioned to have a length extending along the length of said slot, a thickness along the width of said slot, and a height in the projecting direction of said post, said slot having a wider section with a width which is greater than the thickness of said trunk and a narrow section at said constriction with a width which is less than the thickness of said trunk, said pilot being tapered to have opposed inclined side faces and a tip of reduced thickness, said pilot being cut off at one longitudinal end portion thereof to define thereat a beveled edge which is angled with a remaining square edge at the tip of said pilot, said pilot dimensioned to be inserted into said slot with said square edge leading into said wider section and with said beveled edge leading into said narrow section so that said post is engaged at a portion adjacent said opposed inclined side faces with said bulges.

2. An electrical connector as set forth in claim 1, wherein said beveled edge is inclined at an angle $\alpha$ of 30° to 80° with respect to said square edge along the length of said pilot.

3. An electrical connector as set forth in claim 1, wherein said inclined side faces are inclined at an angle $\beta$ of 15° to 45° with respect to a vertical line extending along the height of said post.

4. An electrical connector as set forth in claim 1, wherein each of said bulges has a vertex which is continuous with a remaining inner edge of said leg through a slope which is inclined at an angle $\gamma$ of 5° to 45° with respect to said inner edge along the length of said slot.

5. An electrical connector as set forth in claim 1, wherein said socket includes socket terminals which extend respectively from said contacts outwardly of said socket base and are adapted to be bonded to conductors on a first printed board, and wherein said plug includes plug terminals which extend respectively from said posts outwardly of said plug base and are adapted to be bonded to conductors on a second printed board.

6. An electrical as set forth in claim 1 in which the tip has a thickness which is less than the width of said slot at said narrower section.

* * * * *